US008267346B2

(12) United States Patent
Ito et al.

(10) Patent No.: US 8,267,346 B2
(45) Date of Patent: Sep. 18, 2012

(54) SPOOL ASSEMBLY WITH A SEALING BARREL

(76) Inventors: Bill Ito, Cobourg (CA); Mark Ito, Cobourg (CA)

( * ) Notice: Subject to any disclaimer, the term of this patent is extended or adjusted under 35 U.S.C. 154(b) by 303 days.

(21) Appl. No.: 12/656,384

(22) Filed: Jan. 28, 2010

(65) Prior Publication Data

US 2011/0180653 A1 Jul. 28, 2011

(51) Int. Cl.
*B65H 75/14* (2006.01)
*B65H 75/18* (2006.01)

(52) U.S. Cl. ..... 242/608.7; 242/610.3; 242/610.5; 242/613; 242/614; 242/118.61; 242/118.8

(58) Field of Classification Search ..... 242/607, 242/608, 608.2, 608.7, 609, 609.1, 610, 610.1, 242/610.2, 610.3, 610.5, 613, 613.4, 614, 242/614.1, 118.4, 118.6, 118.61, 118.7, 118.8
See application file for complete search history.

(56) References Cited

U.S. PATENT DOCUMENTS 6,289,570 B1 9/2001 Peterson et al.

*Primary Examiner* — William E Dondero
(74) *Attorney, Agent, or Firm* — Arne I. Fors

(57) ABSTRACT

A spool assembly has a central cylindrical barrel or tube portion formed from a substantially rectangular planar material, such as thin-gauge sheet aluminum or tin-plated steel, with beveled corners. The formation of the barrel from the substantially rectangular planar material results in a seam with shallow V-notches of the seams at the opposite ends of the barrel. A circular flange sub assembly is attached to each end of the barrel and extends radially outwardly perpendicular to the longitudinal axis of the barrel. Each flange sub assembly comprises an outer flange and an inner flange core joined by an annular ring or curl that defines a circular hub recess or cavity for receiving the respective end of the barrel. A portion of the seam at the end of the barrel is secured within the circular hub recess or cavity; whereby the flanges are keyed onto the ends of the barrel, thereby preventing circumferential slippage of the flanges on the barrel.

11 Claims, 5 Drawing Sheets

Fig.1
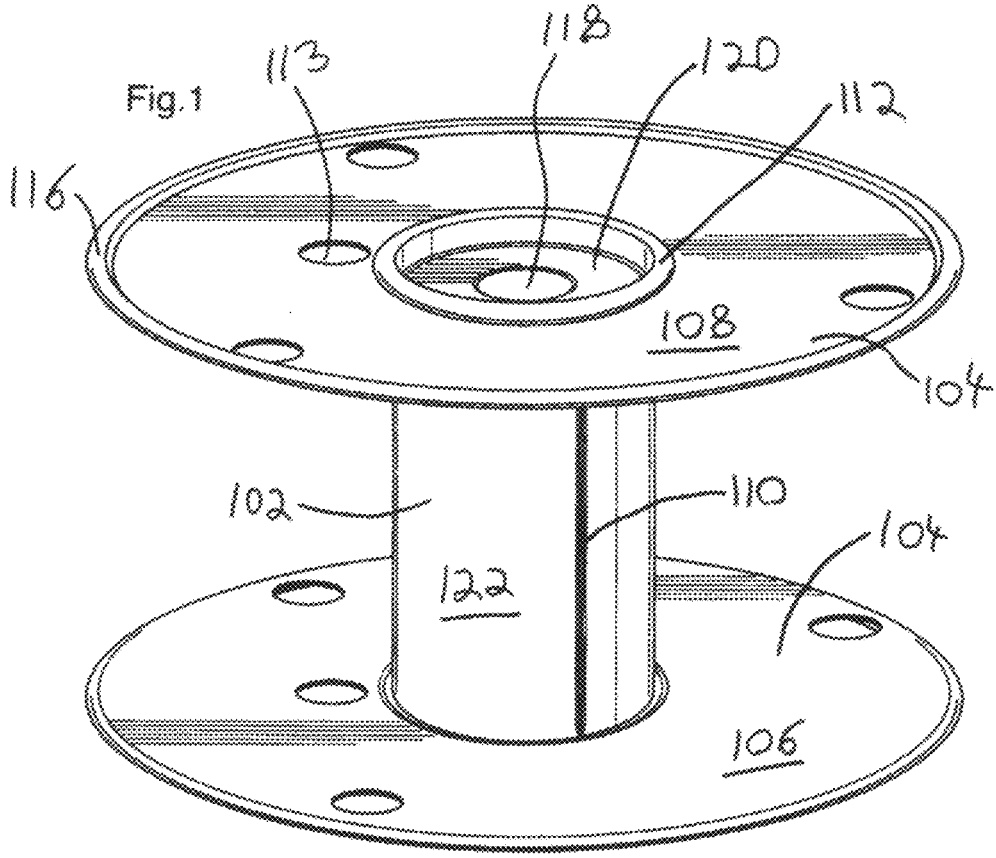
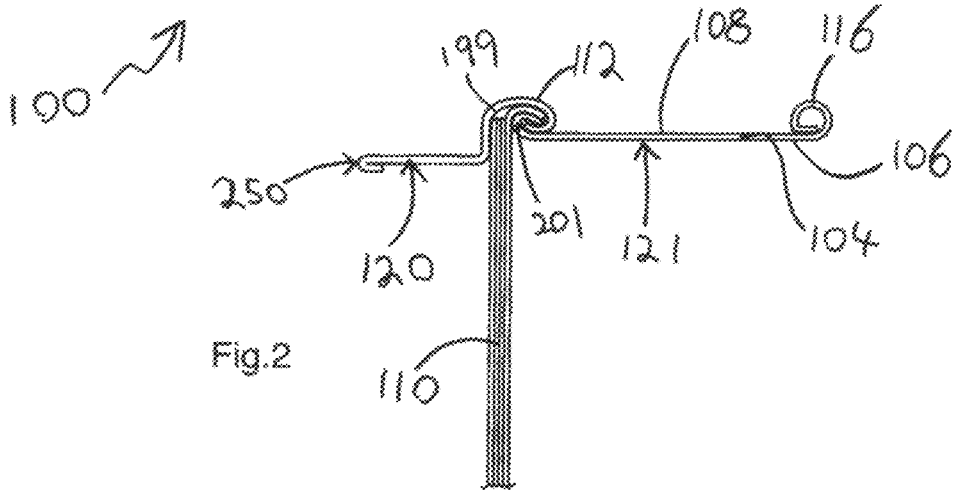
Fig.2

Fig.7 Prior Art
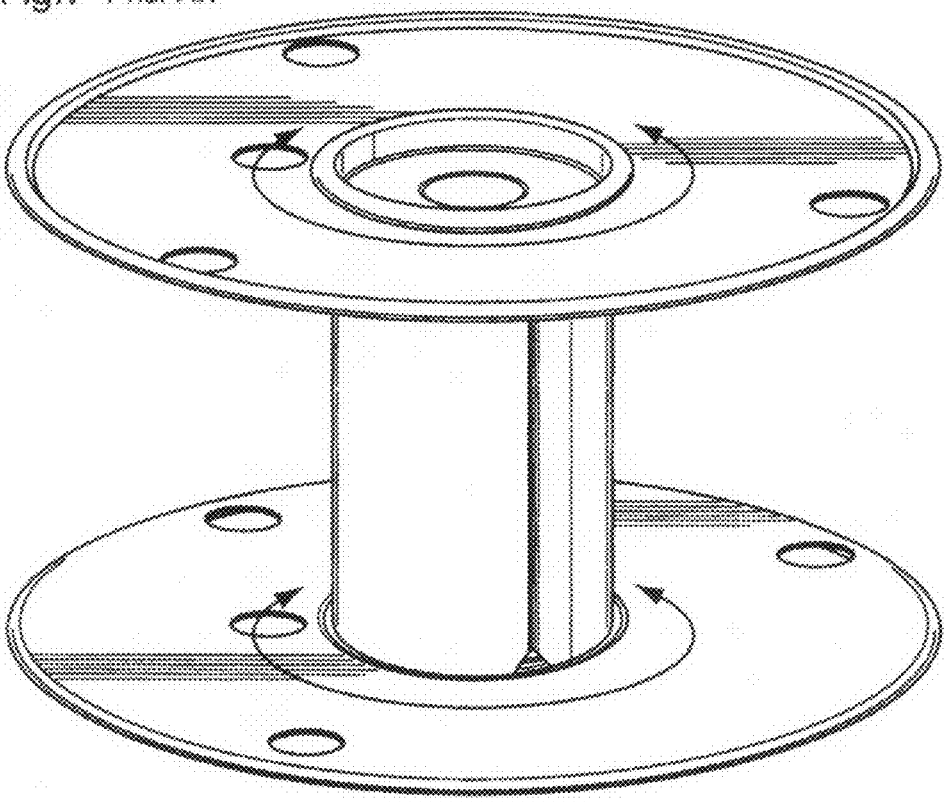
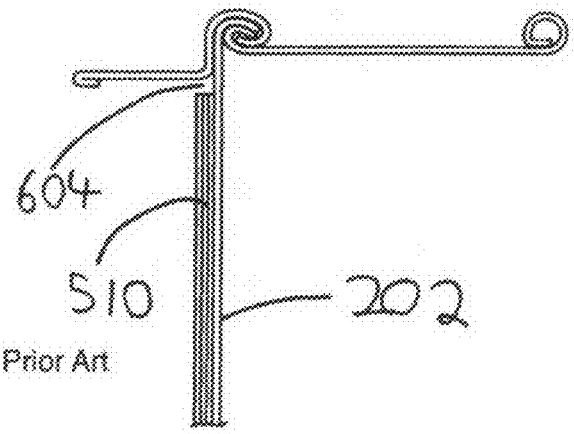
Fig.8 Prior Art

SPOOL ASSEMBLY WITH A SEALING BARREL

FIELD OF THE INVENTION

This invention relates to spools for receiving wire, cord, string and like stranded materials wound thereon and in particular relates to a metal spool assembled from three components.

BACKGROUND OF THE INVENTION

Conventional spools and reels for drawing or winding cordage such as wire, cord, string, cable and the like stranded material onto the spool or reel are fabricated from wood, metal and plastic materials. The spools must be able to transfer cordage between the barrel or tube portion and the end flanges of the spools during winding of the cordage onto the spool and must have sufficient strength and stiffness to not only support the load of the cordage but also to avoid failure of the flanges when transporting and loading and unloading loaded spools.

A disadvantage of current three-piece metal spools, however, resides in the difficulty of assembling the end flanges to the ends of the barrel. It is known to provide tabs at the ends of the barrel which fit through punched out holes in the flanges and are crimped to the flanges. However, the tabs can become dislodged from the flanges causing the spools to collapse and lose their load of cordage.

It is also known to provide a curl joint between the flanges and the barrel. The flanges are not fastened to the barrel and are prone to slip circumferentially with respect to the barrel. Each flange has a central arbor hole for receiving a shaft through the hollow barrel for rotating the spool during loading and unloading of cordage by winding of the spool by engagement with drive holes formed in the flanges. Slippage of the flanges on the barrel impedes winding of cordage on the spools during loading.

It is a principal object of the invention therefore to provide a spool assembly having the flanges locked or keyed onto the barrel to prevent circumferential slippage of the flanges on the barrel.

U.S. Pat. No. 6,289,570 issued Sep. 18, 2001 discloses a die and a method for assembling five-piece spools comprised of a cylindrical barrel and a pair of two-piece flange sub assemblies disposed at opposite ends of the barrel. Each two-piece flange sub assembly comprises a disc-shaped outer flange having a central circular hub opening for receiving an end of the barrel therein and a flange core disposed in the hub opening. The outer flange, barrel end and flange core are joined together at the central hub opening by a curl joint formed of closely interfitting curled metal edges of the outer flange, cylindrical barrel end and flange core. The curl joint is tightened by a die which concurrently forms detents at a plurality of locations around the tightened curl to lock the two-piece flange sub assembly to the barrel and provide transfer torque between the spool components during wire winding. The die is complex and the method for assembly requires an additional operational step.

It is another object of the present invention therefore to provide a simple and inexpensive five-piece spool assembly which can be readily manufactured from sheet metal, which is light in weight while having a strong and rigid construction, and which keep keys the flanges to the barrel to prevent circumferential slippage.

SUMMARY

Described herein is a spool assembly for containing stranded material. The spool assembly has a central cylindrical barrel or tube portion formed from a substantially rectangular planar material such as thin-gauge sheet aluminum or tin-plated steel with beveled corners. The formation of the barrel from the substantially rectangular planar material results in a seam with a shallow V-notch at each end of the barrel where two ends of the planar material are joined. A circular sub assembly flange is attached to each end of the barrel and extends radially outwardly perpendicular to the longitudinal axis of the barrel. Each flange sub assembly comprises an outer flange and an inner flange core joined by an annular ring or curl that defines a circular hub recess or cavity for receiving the respective end of the barrel. A portion of the seam at the end of the barrel is secured within the circular hub recess or cavity; whereby the flanges are keyed onto the ends of the barrel, thereby preventing circumferential slippage of the flanges on the barrel.

According to one aspect of the invention, disclosed is a spool assembly for containing a stranded material, comprising: a barrel for receiving and dispensing a stranded material wrapped circumferentially therearound, the barrel formed from a planar member having opposed edges formed into a tube having a longitudinal axis, the opposed edges joined to form a seam parallel to the longitudinal axis, said barrel having a first end axially opposed to a second end; a first flange sub assembly having a first central recess for receiving the first end of the barrel wherein a portion of the seam is secured within the first central recess; and a second flange having a second central recess for receiving the second end of the barrel wherein a portion of the seam is secured within the second circular recess.

According to another aspect of the present invention, disclosed is a method of manufacturing a spool assembly, comprising providing a substantially rectangular planar material having beveled corners on opposite edges, forming a cylinder from the substantially rectangular planar material by joining the opposite edges in a longitudinal seam having shallow V-notches at opposite ends of the seam, the cylinder defining a first end opposite a second end; attaching a flange sub assembly comprised of a flange core and outer flange joined at a hub curl defining an inner cavity to the opposite ends of the cylinder by inserting an end into the hub cavity whereby a portion of the seam is gripped within the hub cavity of the flange sub assemblies.

More particularly, the sheet-metal spool assembly for containing a stranded material, comprises a cylindrical barrel having a pair of opposite ends and a longitudinal seam formed thereon extending from one end of the barrel to the other end, a shallow V-cut formed in each end of the barrel at the seam, a circular outer flange attached to each end of the barrel, each said circular outer flange having a central circular hub opening for receiving an end of the barrel therein at a juncture thereof, a flange core having an arbor aperture, extending radially inwardly from the hub opening at the juncture, and a curl joint at the juncture for joining the outer flange and the flange core to each barrel end, whereby a portion of the seam of the barrel is gripped in the curl joint between the end of the barrel, the flange core portion and the flange, to key the flange core portion and the outer flange to the end of the barrel to prevent circumferential movement of the flange core portion and flange on the barrel.

BRIEF DESCRIPTION OF THE DRAWINGS

In order that the subject matter may be readily understood, embodiments are illustrated by way of examples in the accompanying drawings, in which:

FIG. 1 is a perspective drawing of an exemplary embodiment of a spool assembly in accordance with the present invention;

FIG. 2 is a cut-out sectional view of the spool assembly of FIG. 1 showing the seam of the barrel secured in the rolled-up lip;

FIG. 7 is a perspective view of a spool according to the prior art;

FIG. 8 is a cut-out sectional view of the spool assembly of FIG. 7 showing the seam of the barrel outside of the rolled-up lip;

DETAILED DESCRIPTION

Figure 3:
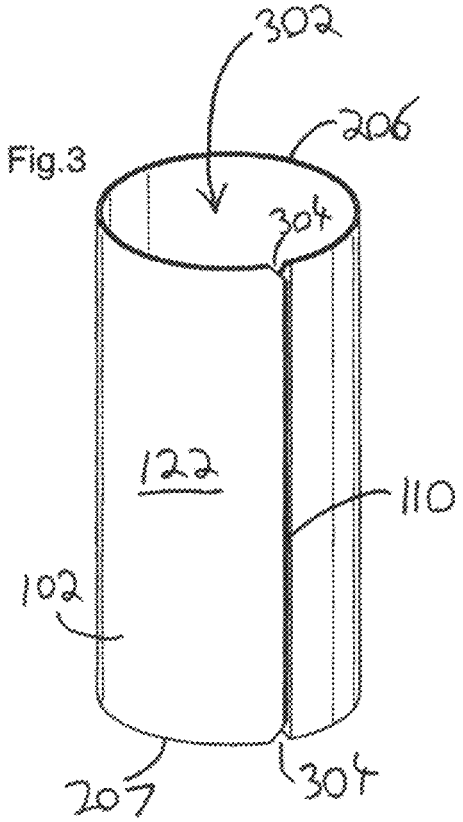
FIG. 3 is a perspective view of an exemplary embodiment of a barrel in accordance with the present invention.

With reference to FIG. 1, a spool assembly 100 is for containing cordage such as wire, cord, string, cable and the like stranded material wound on the cylindrical barrel 102 between two opposing outer end flanges 104.

The barrel 102 is a tube-shaped member with a seam 110 running longitudinally along its length. The barrel 102 has a cylindrical spooling surface 122 around which stranded material may be circumferentially wrapped for receiving and/or dispensing. The barrel 102 may be formed from a substantially rectangular planar material such that the formation of the tubular barrel 102 results in the longitudinal seam 110 running along its length.

Figure 9:
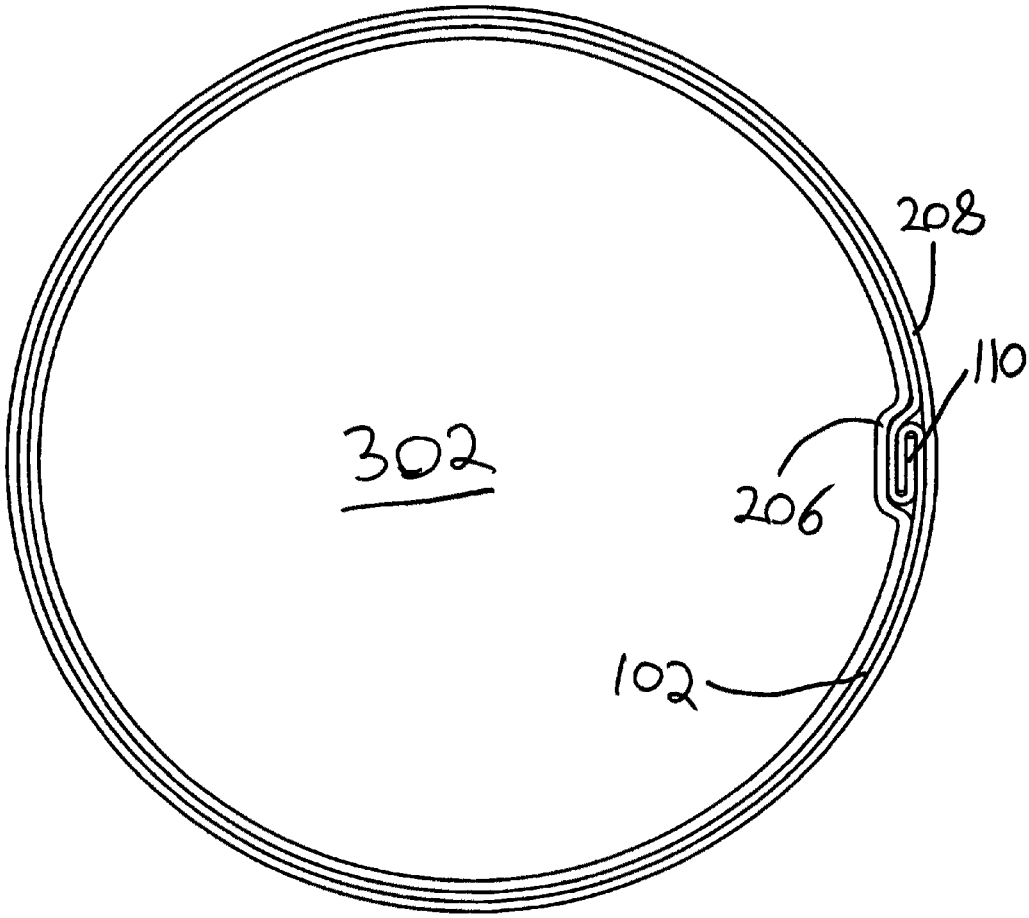
FIG. 9 is a top plan cut-out view of the spool assembly of FIG. 1 showing the seam of the barrel secured in the rolled-up lip.

To form the cylindrical barrel 102 according to an exemplary embodiment, the substantially planar material with beveled corners is formed into a tube with the two ends of the material slightly overlapping. The two overlapping ends are bent around one another to form the seam 110 (see FIG. 9). The end strip of the first end is bent or folded back towards itself; the other end is similarly bent or folded back towards itself and is further interlocked within the bend formed by the first end. As a result the seam 110 created by the formation of the barrel 102 has a thickness greater than the thickness of the remainder of the planar material which forms the barrel 102. In the particular embodiment shown in FIG. 9, the thickness of the seam 110 is four times the thickness of the remainder of the barrel 102. The seam 110 protrudes inward from the barrel 102 surface (i.e. towards the cavity 302 in the centre of the tube-shaped barrel 102) so that there is no bulge or protrusion on the exterior cylindrical surface 122 of the barrel 102. The beveled opposite ends of the seam 110 define a shallow V-notch 304 shown most clearly in FIGS. 3 and 4, for reasons which will become apparent as the description proceeds. With reference to FIG. 2, when the spool is assembled a portion of the seam 110 extending along the length of the barrel 102 extends into the interior of the central cavity on the inside of the curl 112.

Circular flange sub assemblies 103 are attached at either end of the barrel 102 consist of outer flanges 104 which extend outwardly perpendicular from the barrel 102 and inner flange cores 120 which extend inwardly therefrom. Each outer flange 104 is substantially planar and has an inner smooth surface 106 opposite an outer surface 108. The inner surface 106 faces the spooling surface 122 of the barrel 102 and the outer surface 108 faces outwardly from the barrel 102.

An exterior rim lip 116 extends outwardly from the outer surface 108 of the flange 104 and runs circumferentially along the perimeter of the flange 104. The exterior lip is formed by bending or rolling the outer edge of each flange 104 outwardly (see FIG. 2). The outer flange 104 also has an interior lip 201 which runs in a circumference corresponding to and coaxial to the end of the barrel 102. The interior lip 201 curls outwardly about 180° to the outer surface 108 of the outer flange 104. The flange core portion 120 of the flange sub assemblies 103 has a curl 112 formed in the outer edge of flange core 120 which is bent inwardly about 180° to grip lip 201 of outer flange 104. The flange core 120 extends axially inwards from the curl 112 forming a round narrow cylindrical section 114 adjacent the end 206 of the barrel 102.

In the preferred embodiment described herein, the opposing flange sub assemblies 103 have the same shape and dimensions. The description that follows may therefore refer to a single flange sub assemblies 103, it being understood that the description applies equally to both opposing flanges sub assemblies 103.

There is also a central hole 118 at the center of the flange core 120 of the flange sub assemblies 103. The central hole 118 is circular and has diameter less than the diameter of the end of the barrel 102 defining an arbor aperture. Preferably the edge defining the arbor aperture of the flange core 102 is rolled or curled inwards so that a dull edge 250 is formed (see FIG. 2) for receiving an arbor.

Flange 104 extending outwardly from the barrel 102 contains an inner start hole 113 adjacent the outer surface of the barrel 102 for receiving an end of stranded material for winding the stranded material as the spool is rotated about the arbor axis and preferably a plurality of circumferentially spaced finish holes in proximity to the perimeter of the flange 104 for receiving the trailing end of the stranded material to prevent unraveling from the spool.

The flanges thus are formed from two separate pieces: the interior flange core 120 and the outer extending flange 104. The interior flange core 120 and outer flange 104 are joined through the formation of the curl 112 at the hub of the flange, described as follows. The interior edge 201 of the flange 104 is folded outward upon itself at an approximately 180° angle forming a cavity (see FIGS. 2 and 10). The exterior edge 111 of the flange core 120 is folded inward upon itself an angle of approximately 180° forming a cavity. The two cavities are formed simultaneously such that the cavity formed by the flange 104 is interlocked with the cavity formed by the flange core 120. This interlocking creates the hub curl 112. On the underside of the hub curl 112 the interlocking edges of the interior flange core 120 and extending portion 121 form the central cavity 109. During formation of the flanges sub assemblies 103 (i.e. when the flange core 120 is folded over the outer flange 104) the edge 206 (and analogously the opposite edge 207) of the barrel 102 is inserted into the cavity 109 so that the a portion of the barrel 102 material is secured within the curl 112 whereby the end of the barrel 102 is sandwiched within the fold.

Figure 4:
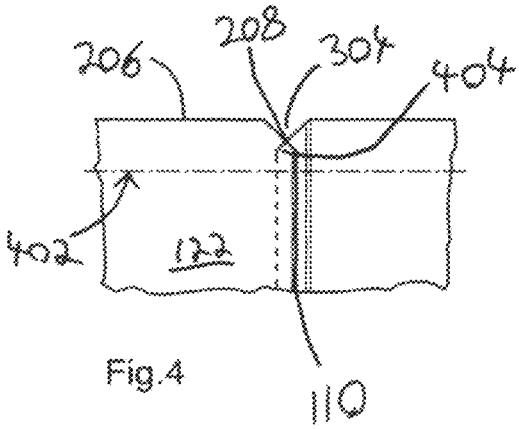
FIG. 4 is a cut-out plan view of the seam of the barrel of FIG. 3.

In accordance with the present invention a portion of the seam 110 extends into and is secured within the cavity 109 formed by the curl 112 between the interior lip wall 201 and exterior lip wall 199. The V-notch 304 thus is of a depth less than the depth of the interior cavity of the interior lip 112. In FIG. 4 the depth of the underside cavity is shown at the broken line 402. The apex portion 208 of the notch 304 and a portion 404 of the overlapped seam 104 thus is within the interior cavity.

Figure 5:
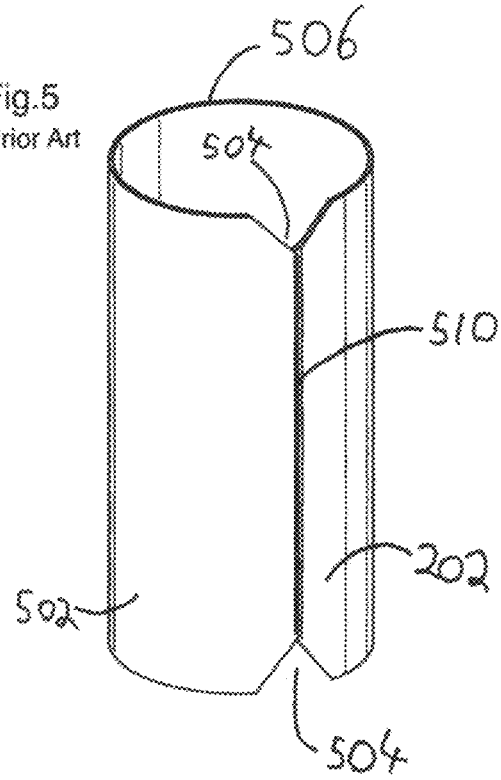
Fig.5 Prior Art
FIG. 5 is a perspective view of a barrel according to the prior art.
Figure 6:
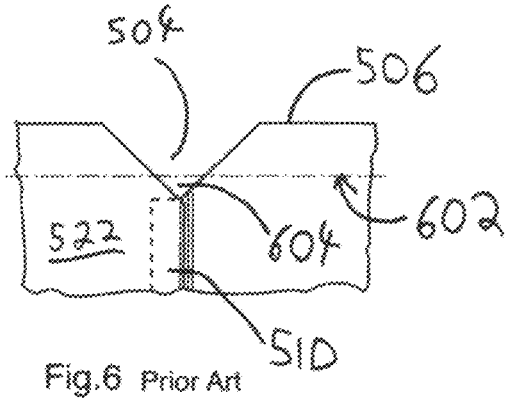
Fig.6 Prior Art
FIG. 6 is a cut-out plan view of the seam of the barrel of FIG. 5.

With reference now to the prior art shown in FIGS. 5-8, deep V-shaped notches 504 are formed in the edges 506, 507 of the barrel 502 at the ends of the seam 510. FIGS. 5 and 6 depict the notches 504 in detail. The notches are pre-cut (i.e. before forming the tube) and typically are about ¼ deep. Before the substantially rectangular planar material is formed into the tube during construction of the barrel 502, the corners of the material are cut to provide a beveled corner. When the barrel 502 is formed the beveled corners come together to form the "V"-shaped notch 504.

With reference to FIG. 8, in accordance with the prior art, the edge of the end of the barrel was secured within the cavity in the underside of the interior lip. However, because the notch 504 formed in the ends of the tubular barrel 502 has depth greater than that of the cavity, the seam 510 in the prior art barrel 502 does not enter into the hub cavity of the curl 528 at the juncture of the flange core 530 and outer flange 532.

The depth of the underside cavity from the top 506 of the barrel 502 is shown by the broken line 602 (FIG. 6). A portion of the space defined by the notch 504 is within the depth of the underside cavity, with the portion 604 of the space defined by the notch outside the depth of the underside of the cavity (FIG. 8). According to the prior art, therefore, there is a gap 604 between the apex 208 of the notch 304 and the underside of the flange core 530, and accordingly the seam 510 is not captured, permitting the flange core 530 and outer flange 532 to slip and rotate on barrel 502, as indicated in FIG. 7.

Figure 10:
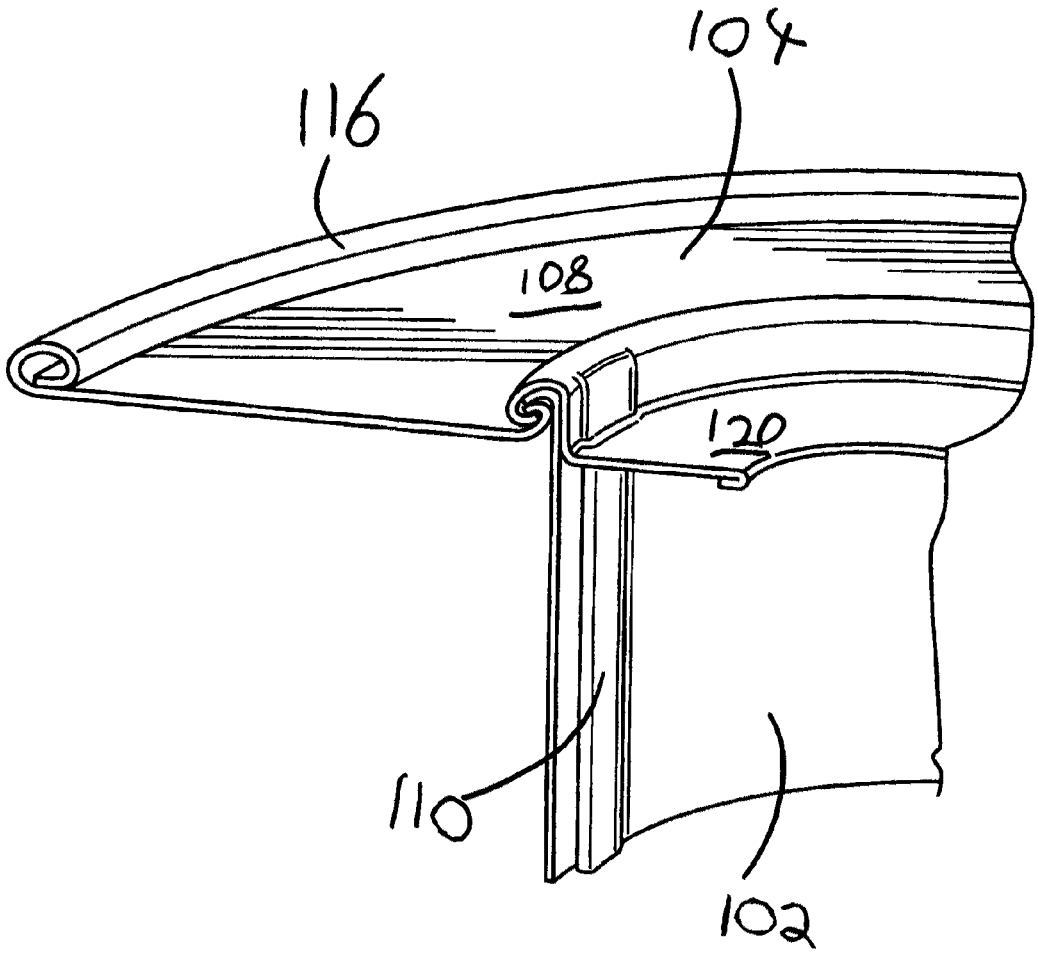
FIG. 10 is a perspective cut-out view of the spool assembly of FIG. 1 showing the seam of the barrel secured in the rolled-up lip.

As shown in FIG. 10, the curl 112 in which the end of the barrel 102 is secured forms a hub ring. The portion of the curl 112 in which the seam 110 is secured bulges slightly inwardly as depicted by numeral 121 due to the multiple layers of material on the seam 110.

The present invention provides a number of important advantages. The outer flange 104 and flange core 120 will remain secured to the barrel 102 and will not rotate with respect to the barrel 102 as compared to spool assemblies which do not secure the seam. No additional crimping equipment is required and keying of the flange sub assemblies occurs during the assembly of the spool components.

Although specific embodiments of the invention have been described herein, it will be understood by those skilled in the art that variations may be made thereto without departing from the spirit of the invention or the scope of the appended claims.

The invention claimed is:

1. A sheet-metal spool assembly for containing a stranded material, comprising:

a cylindrical barrel having a pair of opposite ends and a longitudinal seam having a width and opposite ends formed thereon extending from one end of the barrel to the other end, a shallow V-cut formed in each end of the barrel at the seam, said V-cut having a width substantially equal to the width of the seam, a circular outer flange attached to each end of the barrel, each said circular outer flange having a central circular hub opening for receiving an end of the barrel therein at a juncture thereof, a core flange, having an arbor aperture, extending radially inwardly from the hub opening at the juncture, and a curl joint at each juncture for joining the outer flange and the flange core to each barrel end, whereby a portion only of the end of the seam at each end of the barrel is gripped in the curl joint between the end of the barrel, the flange core portion and the flange, to key the flange core portion and the outer flange to the end of the barrel to prevent circumferential movement of the flange core portion and flange on the barrel.

2. A sheet metal spool assembly as claimed in claim 1, wherein the flange core portion and the flange are curl-formed about 180° and the end of the barrel about 90° in the curl joint.

3. A spool assembly for containing a stranded material, comprising:

a barrel for receiving and dispensing a stranded material wrapped circumferentially therearound, the barrel having a first end axially opposed to a second and with a longitudinal seam having a width extending therebetween said seam having a shallow V-cut equal to the width of the seam formed at each end thereof;

a first flange having a first central recess for receiving and engaging the first end of the barrel wherein a portion only of the seam having the V-cut at the first end of the barrel is engaged and defines a key for securing within the first central recess; and a second flange having a second central recess for receiving the second end of the barrel wherein a portion only of the seam having the V-cut at the second end of the barrel is engaged and defines a key for securing within the second central recess.

4. The spool assembly of claim 3 wherein at one of the first flange and second flange comprises:

an extending portion extending outwardly and perpendicularly from the surface of the barrel, the extending portion having an inner edge; and an interior portion extending inwardly from the surface of the barrel, the interior portion having an outer edge, wherein the inner edge of the extending portion and the outer edge of the interior portion for joining to define the first and second central recesses for receiving the barrel.

5. The spool assembly of claim 4, the extending portion having an exterior edge defining an exterior lip.

6. The spool assembly of claim 4 wherein the joining of the inner edge of the extending portion and the outer edge of the interior portion defining an interior lip.

7. The spool assembly of claim 4 wherein one of the first end and the second end of the barrel are encased in the first and second central recesses.

8. The spool assembly of claim 4 the interior portion having an inner edge defining a circular central aperture.

9. The spool assembly of claim 8, the inner edge bent to form a dull edge.

10. The spool assembly of claim 3 wherein the first flange and second flange are each circular.

11. The spool assembly of claim 3, the barrel defining an interior cavity, the seam bulging toward the interior cavity.

* * * * *